United States Patent [19]

Kaiser, Jr.

[11] 4,443,976

[45] Apr. 24, 1984

[54] CYLINDRICAL GRINDING MACHINE

[75] Inventor: Russell E. Kaiser, Jr., Mercersburg, Pa.

[73] Assignee: Litton Industrial Products, Inc., Waynesboro, Pa.

[21] Appl. No.: 344,065

[22] Filed: Jan. 29, 1982

[51] Int. Cl.[3] ..... B24B 5/00

[52] U.S. Cl. ..... 51/97 NC; 51/101 R

[58] Field of Search ..... 51/97 NC, 101 R, 165.71, 51/165 TP

[56] References Cited

U.S. PATENT DOCUMENTS

| | | | |
|---|---|---|---|
| 4,214,309 | 7/1980 | Koide | 51/97 NC |
| 4,299,061 | 11/1981 | Parnum | 51/101 R |
| 4,343,114 | 8/1982 | Tourasse | 51/101 R |

*Primary Examiner*—Harold D. Whitehead

*Attorney, Agent, or Firm*—Spencer T. Smith

[57] ABSTRACT

A cylindrical grinder for effecting stock removal from a cam surface on a workpiece, the cam surface including a base portion, a nose portion and flank portion joining the base and nose portions, the nose portion having a smaller radius of curvature than the base portion and being more distant from the axis of rotation of the cam than the base portion, comprising means for supporting the workpiece for rotation about a predetermined axis, means for defining a selected velocity profile for each revolution of the cam, the velocity profile having a plurality of acceleration/deceleration segments whereby the velocity of the surface of the cam at the grinding location is selectively varied, stock removal means including a grinding wheel and grinding wheel feed control means, the grinding wheel feed control means including rough feed control means having means for infeeding the grinding wheel at a plurality of sequentially operable feeds, finish control means having means for infeeding the grinding wheel at a plurality of sequentially operable feeds, means for sensing the presence of a selected point on the cam surface at a predetermined angular location, and means for actuating one of the rough and finish feed control means at the first of the plurality of feeds when the selected point is sensed and for sequentially actuating each of the remaining plurality of feeds when the selected point is sensed each of the next remander of the same plurality of revolutions.

3 Claims, 6 Drawing Figures

CYLINDRICAL GRINDING MACHINE

The present invention relates to cylindrical grinding machines and more particularly to cylindrical grinding machines which effect stock removal from a rotating workpiece such as a cam on an automotive camshaft.

Cylindrical grinding is the machining process whereby stock is removed from the periphery of a cylindrical workpiece. Such stock removal normally occurs in a programmed sequence including rough and finish portions.

When grinding a cylindrical workpiece in a conventional cylindrical grinder, the workpiece is rotated on centers at a constant rate of revolutions per minute and the point of grinding wheel contact with the workpiece progresses around the workpiece at a constant circumferential distance for each degree of workpiece rotation. Accordingly, uniform stock removal takes place.

When grinding a non-cylindrical workpiece, such as an automotive cam on a camshaft, and the workpiece is rotated on centers at a constant rate of revolutions per minute, the point of contact of the grinding wheel with the cam being ground progresses around the cam at a radically variable circumferential distance for each degree of rotation during some portions of the circumference. This results in a non-uniform rate of stock removal.

To achieve a more uniform rate of stock removal, the non-cylindrical surface can be effectively treated as a cylindrical surface by varying the rate of rotation of the cam surface as a function of its orientation. This variation of rotating speed is achieved in the manner disclosed in U.S. Pat. application Ser. No. 308,232, filed Oct. 2, 1981.

Conventionally, when such a system is utilized, the machining operation on a particular cam surface is controlled by a feed program which has rough and finish portions.

In a conventional rough portion of the feed program there are seven discrete feed segments wherein the grinding wheel is advanced approximately 0.010 inch for each feed segment. Each feed segment is time controlled (the stock to be removed requires an infeed having a predetermined time duration). A short dwell of predetermined length follows whereupon the next feed segment is begun.

In the conventional finish portion of the feed program, the commencement of an infeed segment was controlled by a switch mechanism mounted on the work center assembly.

Following the seventh dwell in the rough portion of the program, the switch mechanism would be enabled to start the fine feed portion of the program. The grinding wheel would be infed 0.007 inch and would be infed another 0.002 inch when the switch mechanism was again actuated after one revolution.

It is an object of the present invention to achieve a more uniform stock removal than that heretofore achievable and to achieve this objective in a shorter cycle time.

Other objects and advantages of the present invention will become apparent from the following portion of this specification and from the accompanying drawings which illustrate, in accordance with the mandate of the patent statutes, a presently preferred embodiment incorporating the principles of the invention.

Referring to the drawings.

A conventional cam contour grinding machine 10 includes opposing head and foot stock assemblies which are supported by a base. The camshaft 12 supported between the stocks includes a plurality of axially spaced cams 14. The stocks are laterally displaceable to axially index the camshaft to sequentially locate each cam in front of the grinding wheel assembly including a grinding wheel 16 which is advanceable in accordance with a predetermined infeed program to effect the desired grinding wheel penetration. To maintain the rotatably driven camshaft in constant contact with the rotating grinding wheel, the stocks are also conventionally selectively rockable to displace the camshaft towards and away from the grinding wheel.

Camshafts are utilized in internal combustion engines and include a plurality of cams which are associated with each cylinder. A camshaft for a gasoline engine has intake and exhaust cams, and a camshaft for a diesel engine has intake, exhaust and injector cams. Since the contour of these cams are different and since the orientation of one set of cams may be different than that of another set, a cam contour grinding machine conventionally includes a corresponding number of master cams (not shown) properly oriented to control the rocking motion for each cam on the camshaft.

Each cam generally includes a nose portion N, a base portion B defined by a radius R, and opposing flank portions F1, F2 which join the nose and base portions.

Since the base, which extends greater than 180°, is cylindrical relative to the axis of rotation of the camshaft, rotating the camshaft at a constant velocity ($V_b$) during the period that this portion contacts the grinding wheel will achieve uniform wheel penetration and uniform stock removal. In the preferred embodiment, the cam is rotated at a velocity of 60 rpm for approximately 210°. The cam is rotated at a second velocity ($V_f$) of 10 rpm along a portion of each flank F1, F2 and at a third velocity ($V_n$) of 120 rpm around the nose.

Acceleration (or deceleration) segments A1, A2, A3, A4 interconnect these constant velocity segments. An acceleration or deceleration segment includes two basic components; radiused end portions (E1, E2) (E3, E4), (E5, E6), (E7, E8) defined by radii (R1, R2), (R3, R4), (R5, R6), (R7, R8) which tangentially merge into their associated constant velocity segment. Such radiused portions may either tangentially merge into each other or they may tangentially interconnect with a linear inclined central portion L1, L2, L3, L4. The location where a constant velocity segment of the cam joins an acceleration or deceleration segment can be referred to as a set point (T1, . . . T8). The set point is preselected from programmed points on the cam contour.

Figure 1:
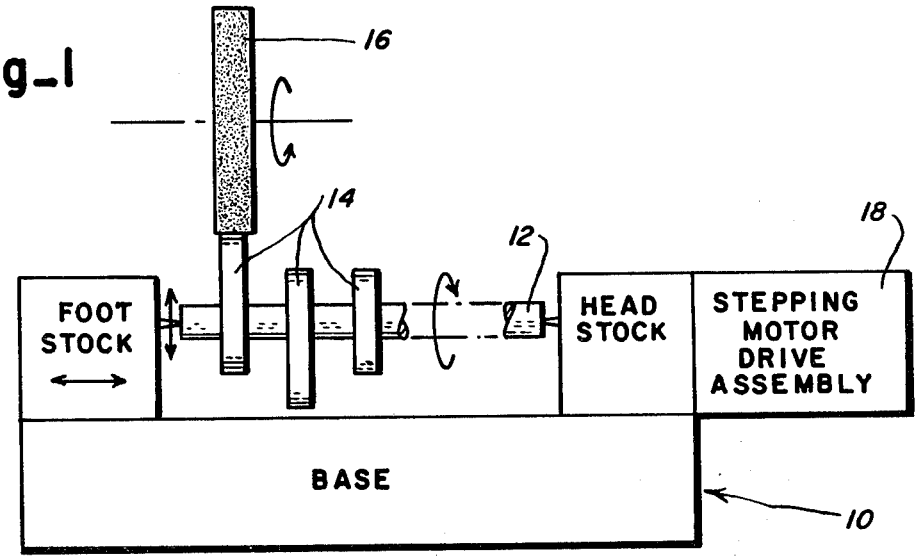
FIG. 1 is a schematic showing of the cam contour grinding machine made in accordance with the teachings of the present invention.
Figure 2:
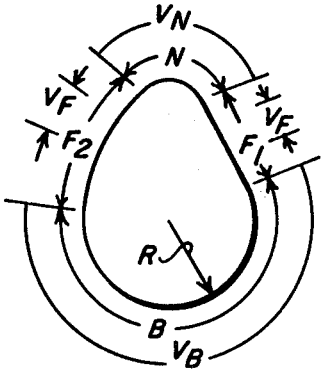
FIG. 2 is an elevational view of a representative cam showing the intersection between the grinding wheel and the cam lobe as ground on the machine illustrated in FIG. 1.
Figure 3:
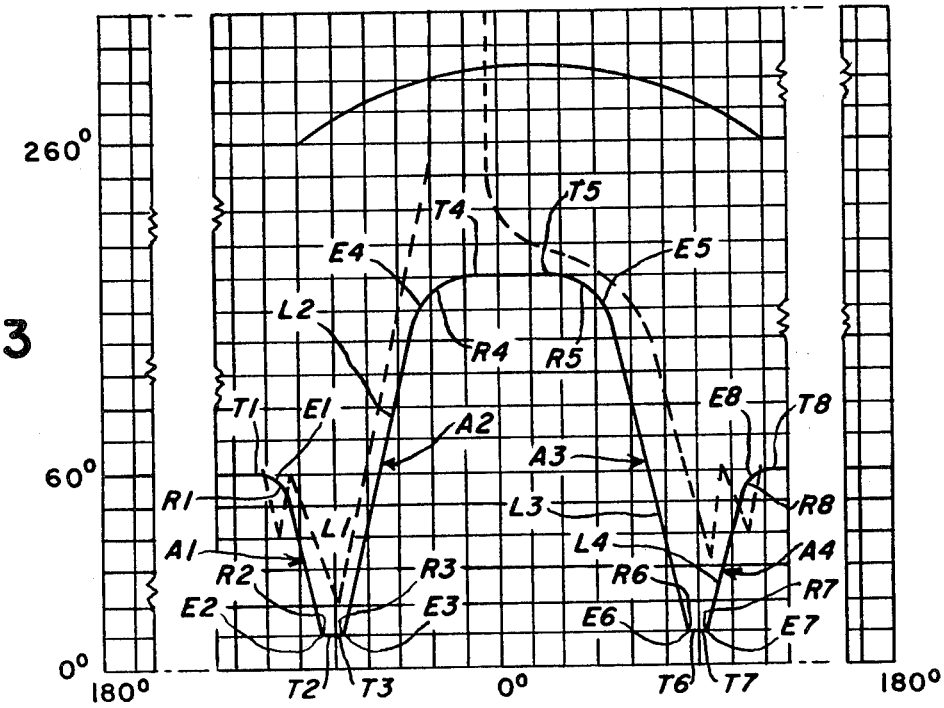
FIG. 3 is a graphical presentation illustrating a lift curve, an actual velocity profile and a command velocity profile for a rough grinding operation of the cam illustrated in FIG. 2.
Figure 4:
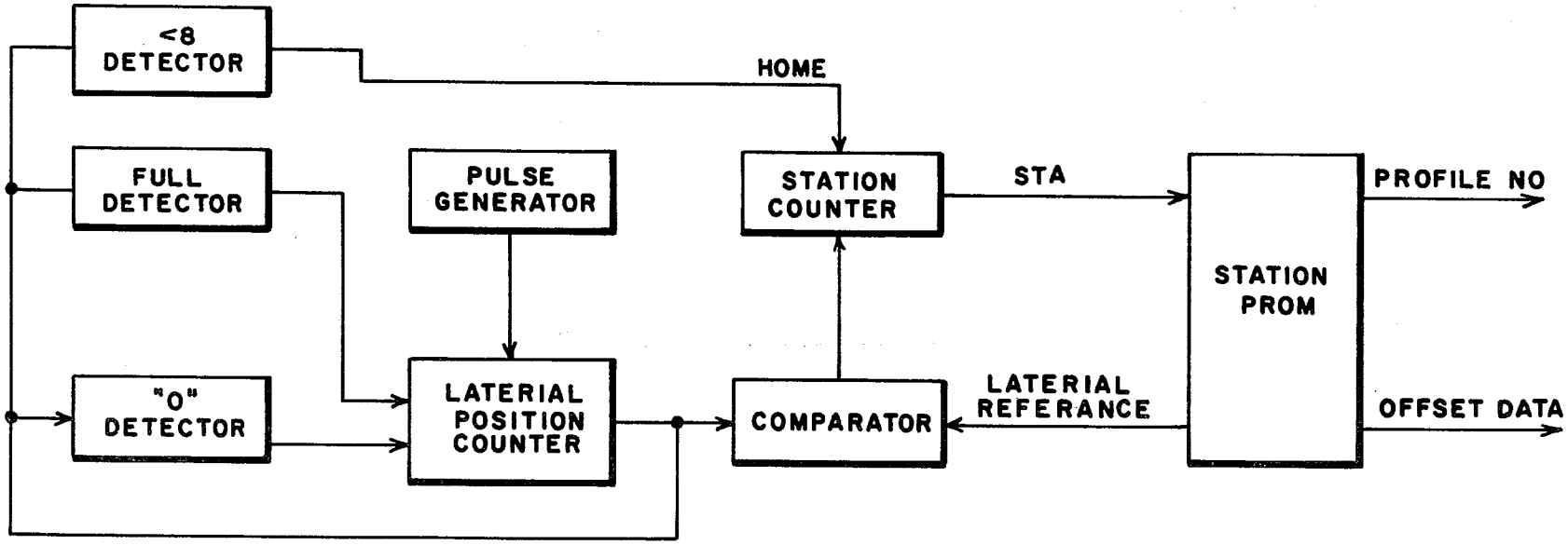
FIG. 4 is a schematic showing of the station identification circuit for the variable speed cam drive for the cam contour grinding machine illustrated in FIG. 1.

The circuit for identifying the cam which is to be ground is shown in FIG. 4. The lateral position of the camshaft is indicated by a Lateral Position Counter driven by a suitable Pulse Generator and the predetermined lateral positions of the camshaft for aligning each cam with the grinding wheel contained in the Station Prom (Programmable read only memory), are compared by a Comparator. When the compared data matches, the Comparator drives a Station Counter which provides the Station Prom with a binary number identifying the cam which is aligned with the grinding wheel. The Station Prom issues a profile number defining the type of cam (intake, exhaust or injector, for example) and an offset which, in effect, will reorient the cam to a desired standard orientation.

Figure 5:
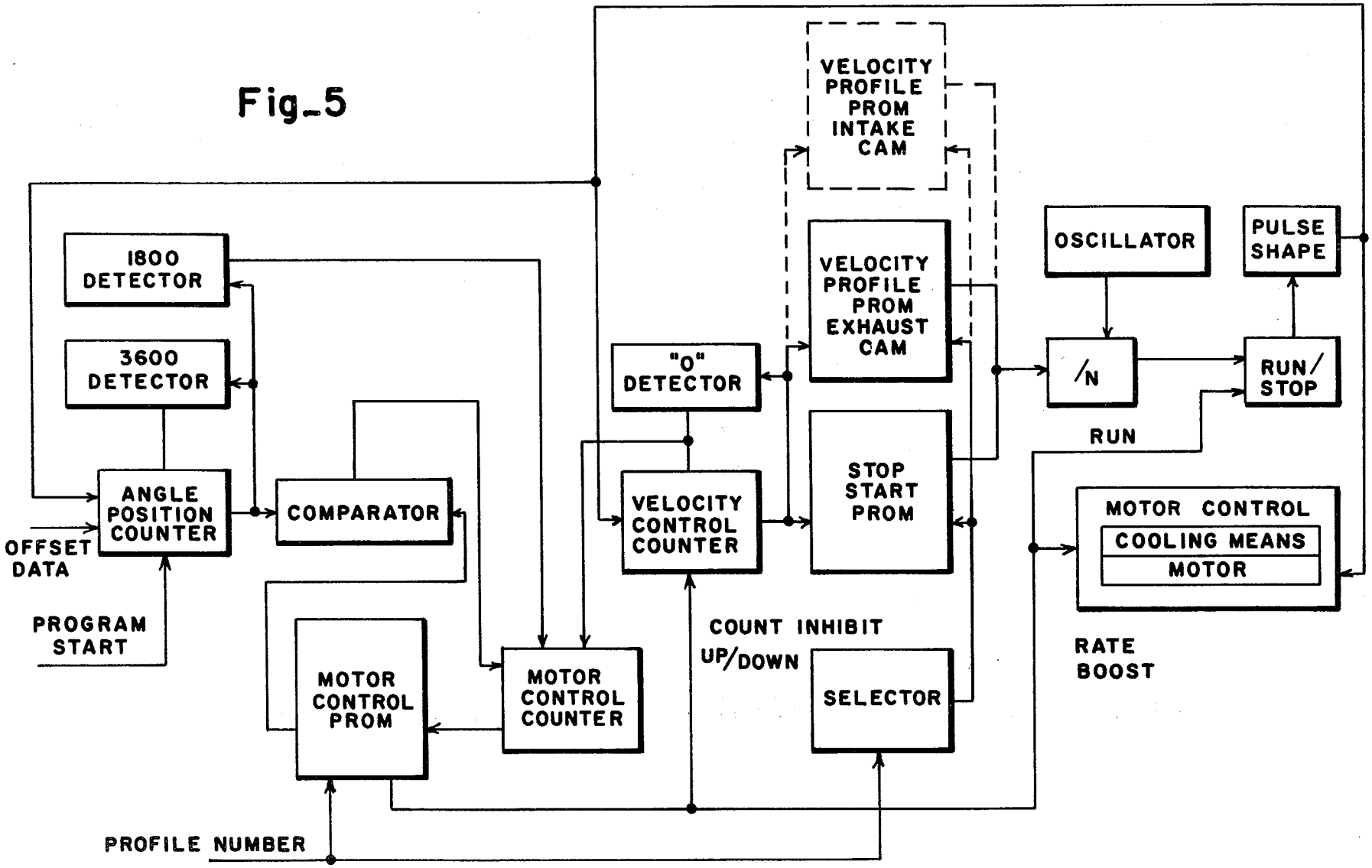
FIG. 5 is a schematic showing of the variable speed cam drive circuit for a cam contour grinding machine illustrated in FIG. 1.

This data is supplied to the variable speed cam drive circuit (FIG. 5). The profile number is supplied to the Selector which selects the set points and velocity profile prom for the cam to be ground. The offset data is loaded into the angle position counter by a Program Start signal which occurs once for every cam revolution. An identical program will be repeated for each complete revolution until sufficient stock removal has been removed from all portions of the cam.

The camshaft is rotatably driven by a stepping motor (Motor Control) which is driven by the clock frequency of the Oscillator divided by the "N" number. An oscillator generates a continuous train of pulses at a fixed rate or frequency. An individual pulse from this train issued to the stepping motor will drive the stepping motor one pulse and a predetermined number of pulses issued to the stepping motor will effect one complete revolution. A divide by "N" circuit defines which pulse in the generated pulse train will be next pulse to pass therethrough and, hence, what time interval between two successive pulses. Stated differently, a divide by "N" circuit will block any selected number of pulses of the train, following a selected pulse, from issuing to the stepping motor. As the camshaft is rotatively driven by the Motor Control through a complete revolution, the Angle Position Counter will be updated by each pulse. If the grinding wheel is contacting a constant velocity segment, the Motor Control Prom will generate a count inhibit (CI) signal which will continue the status of the Motor Control. The address of the divide by N number will, accordingly, remain the same along a constant velocity segment with the stepping motor running at that constant velocity.

When a specific set point is reached, the Motor Control Prom will generate a signal directing the velocity control to either up count or down count, and will delete the count inhibit signal.

As already noted, the set point locates the point on the velocity profile where an acceleration/deceleration segment joins a constant velocity segment. Along a constant velocity segment, the time interval between each pulse will be constant (the N number will not change). To change the velocity, the time interval between each successive pulse generated during a change of velocity will be selected to conform to the profile of the preselected acceleration/deceleration segment. The address will be changed for each successive count throughout the duration of an acceleration/deceleration segment to vary the N number for each successive pulse. Accordingly, a different pulse rate will be established for every step of the stepping motor when proceeding along an acceleration/deceleration segment. When, for example, the velocity is to be reduced, the time interval between successive pulses will be increased (the number of pulses blocked between issued pulses will have to be increased) and this will be effected by changing the N number of the divide by "N" circuit.

When the next set point is supplied from the Angle Position Counter to the Comparator indicating the transition from an acceleration/deceleration segment to a constant velocity segment, a count inhibit signal will again be generated to continue the status of the Motor Control with the stepping motor being driven at the existing velocity.

Each Velocity Profile Prom will contain addressable N numbers defining each of the plurality of acceleration/deceleration velocity profile segments present in the velocity profile for a specified cam. Where the cam is symmetrical, the count direction may be programmed to reverse so that the acceleration/deceleration segment on the back side of the cam will be the mirror image of the acceleration/deceleration segment on the front side.

In a machining operation, the velocity profile for rough and finish feeds may be different. For example, while in a rough feed the nose and base circle speeds may be approximately 75 and 60 rpm, respectively, the speeds in the finish feed portion may be 45 and 60 rpm, respectively.

In the event any slippage is encountered, a synchronization signal will confirm that a velocity profile is commencing at the same point on the cam for each revolution.

Figure 6:
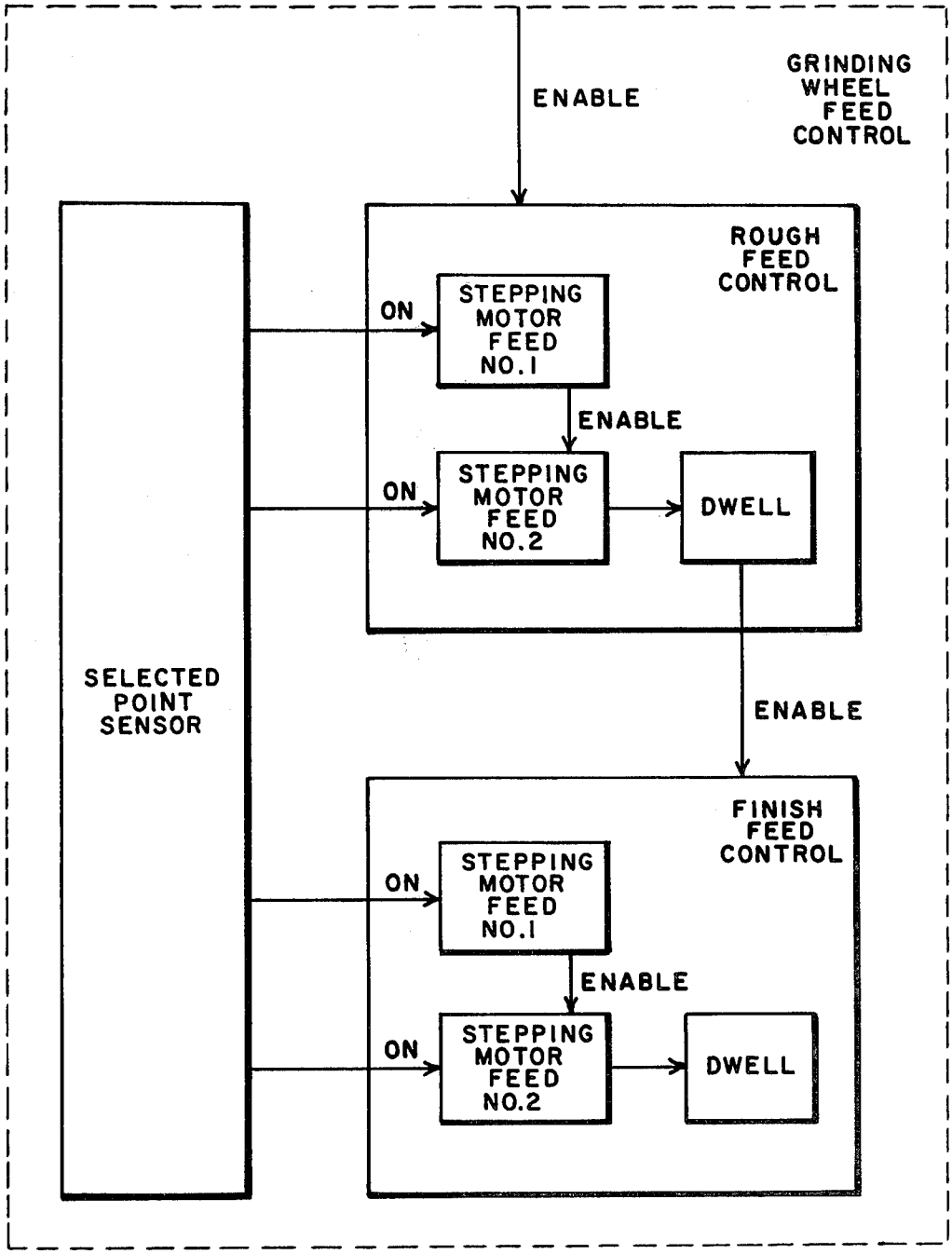
FIG. 6 is a schematic illustration of the grinding wheel feed control circuit of the present invention.

Referring to FIG. 6, the grinding wheel feed control is schematically illustrated. Such a control is utilized in conjunction with an infeed mechanism including a stepping motor which is controlled by pulses supplied by conventional circuitry. The feed program includes two portions, rough and finish feed, and each of these two feed portions has first and second feed segments.

When the Rough Feed Control has been enabled, Rough Feed No. 1 (0.040 inch) will be commenced when a predetermined point (the center of the cam nose) on the cam is located at the grinding location the predetermined point is sensed by the selected point sensor which turns the appropriate stepping motor feed on. The cam will rotate one complete revolution and when this same point is next located at the grinding location, Feed No. 2 will be commenced. Rough Feed No. 2 (0.030 inch) will be followed by a dwell of predetermined duration whereupon the Finish Feed Control will be enabled. When the predetermined point on the cam is next located at the grinding location, Finish Feed No. 1 (0.007 inch) of the enabled Finish Feed Control will be commenced. After one revolution, this predetermined point will again be located at the grinding location and Finish Feed No. 2 (0.002 inch) of the Finish Feed Control will be commenced.

Such a feed program achieves in four feeds what previously required nine feeds, thus substantially reducing the cycle time per cam. It additionally achieves a degree of uniformity in stock removal not achievable heretofore.

The invention claimed is:

1. A cylindrical grinder for effecting stock removal from a plurality of coaxial cams on a workpiece which are to be sequentially located at a grinding location for stock removal, each of the plurality of cams including a base portion, a nose portion and flank portion joining the base and nose portions, the nose portion having a smaller radius of curvature than the base portion and being more distant from the axis of rotation of the cam than the base portion, comprising means for supporting the workpiece for rotation about a predetermined axis coaxial with the axis of the cams, means for defining a selected velocity profile for each revolution of the particular cam which is at the grinding location, the velocity profile having a plurality of acceleration/deceleration segments whereby the velocity of the surface of the cam at the grinding location is selectively varied, stock removal means including a grinding wheel and grinding wheel feed control means, said grinding wheel feed control means including means for infeeding said grinding wheel first and second increments in a rough grinding program, means for sensing the presence of a selected orientation of a rotating cam located at the grinding location, and means for actuating the first feed increment of said rough grinding program when the selected cam orientation is sensed and for actuating the second feed increment of said rough grinding program when the selected orientation is next sensed.

2. A cylindrical grinder according to claim 1, wherein the selected point is the central point on the nose portion of the cam.

3. A cylindrical grinder according to claim 2, wherein said grinding wheel feed control further includes means for infeeding said grinding wheel first and second feed increments in a finish grinding program, and means for actuating the first feed increment of said finish grinding program when the selected cam orientation is sensed and for actuating the second feed increment of said finish grinding program when the selected orientation is next sensed.

* * * * *